US006389987B1

(12) United States Patent
King

(10) Patent No.: US 6,389,987 B1
(45) **Date of Patent: *May 21, 2002**

(54) PLAY TABLE AND MERCHANDISING SYSTEM

(76) Inventor: Christine L. King, 25455 Letchworth Rd., Beachwood, OH (US) 44122

( * ) Notice: Subject to any disclaimer, the term of this patent is extended or adjusted under 35 U.S.C. 154(b) by 0 days.

This patent is subject to a terminal disclaimer.

(21) Appl. No.: 08/800,052

(22) Filed: Feb. 14, 1997

Related U.S. Application Data

(63) Continuation-in-part of application No. 08/377,700, filed on Jan. 25, 1995, now Pat. No. 5,615,619.

(51) Int. Cl.[7] ..... A47B 7/00

(52) U.S. Cl. ..... 108/25; 211/94.01; 211/88.01; 446/103

(58) Field of Search ..... 211/94.01, 189, 211/88.01, 90.01; 108/25, 13, 62, 193, 153.1, 157.1, 90, 186, 187, 108, 159, 158, 158.2; 312/287, 285, 264, 263, 265.5, 351.8, 108, 111, 196, 140.3, 140.4, 280; 297/188.01, 188.08; 446/75, 118, 103; D6/436, 437, 449, 470, 475, 476

(56) References Cited

U.S. PATENT DOCUMENTS

| | | | | |
|---|---|---|---|---|
| 202,294 | A | | 4/1878 | Steves |
| 351,240 | A | | 10/1886 | Adair |
| 1,270,575 | A | | 6/1918 | Wheeler |
| 1,880,386 | A | | 10/1932 | Gray |
| D93,576 | S | | 10/1934 | Rice et al. |
| 2,094,915 | A | | 10/1937 | Dawson |
| 2,240,395 | A | | 4/1941 | Evans |
| 2,708,524 | A | | 5/1955 | Kerr |
| 2,888,147 | A | | 5/1959 | Goldberg |
| 3,066,774 | A | * | 12/1962 | Dahme ..... 108/108 X |
| 3,159,437 | A | * | 12/1964 | Jentzen ..... 108/108 X |
| 3,854,783 | A | * | 12/1974 | Teranishi ..... 108/157.13 X |
| 3,881,274 | A | * | 5/1975 | Kanda ..... 446/103 |
| 4,055,373 | A | * | 10/1977 | Andresen et al. ..... 108/61 X |
| 4,126,230 | A | * | 11/1978 | Tyson et al. ..... 211/189 X |
| 4,507,095 | A | * | 3/1985 | Lin ..... 446/118 |
| 4,807,538 | A | | 2/1989 | Hoffman |
| 4,872,410 | A | | 10/1989 | Lilly |
| 4,986,756 | A | | 1/1991 | Yamaguchi |

(List continued on next page.)

FOREIGN PATENT DOCUMENTS

| | | | | |
|---|---|---|---|---|
| DE | 1176810 | * | 8/1964 | ..... 312/263 |
| DE | 2252499 | * | 5/1974 | ..... 446/118 |
| GB | 1099617 | * | 1/1968 | ..... 108/108 |

OTHER PUBLICATIONS

P. 128 of Little Tikes catalog entitled "4566 Super Storage Building Table" circa 1995.

Two–sided page of Today's Kids catalog showing "4–1 –1 B il 'n Play T ble" circa 1995.

Lego Dacta booklet entitled "Tools for Learning" cover page, pp. 18, 19 and back page 1993.

*Primary Examiner*—Janet M. Wilkens
(74) *Attorney, Agent, or Firm*—Fay, Sharpe, Fagan, Minnich & McKee, LLP

(57) ABSTRACT

A play table and merchandise display center includes a top and first and second legs secured at their upper ends to the top for supporting the top. A bottom wall is secured between the first and second legs. A front wall is secured to the first and second legs adjacent the bottom wall. The front wall cooperates with the first and second legs and the bottom wall to define a bin housed under the top. The front wall is of a lesser height than the first and second legs to define a front opening for the bin. A rear wall is secured to the top and extends above the top. The rear wall cooperates with an associated merchandise holder.

24 Claims, 8 Drawing Sheets

U.S. PATENT DOCUMENTS 5,055,081 A 10/1991 Nayak
5,250,000 A * 10/1993 Boutin et al. ..... 446/75
5,259,803 A * 11/1993 Lyman ..... 446/103
5,299,861 A 4/1994 Foliot et al.
5,327,838 A 7/1994 Beltman
5,375,536 A 12/1994 Peters
5,419,628 A * 5/1995 Myslinki, Jr. et al. .. 312/111 X
5,421,270 A 6/1995 Kelly
5,474,483 A 12/1995 Sun
5,477,971 A * 12/1995 Howard ..... 211/189 X
5,509,844 A 4/1996 Poirier et al.
D370,701 S 6/1996 Thomsen
D371,399 S 7/1996 Pardorf
5,615,619 A * 4/1997 King ..... 108/25

* cited by examiner

FIG. 1
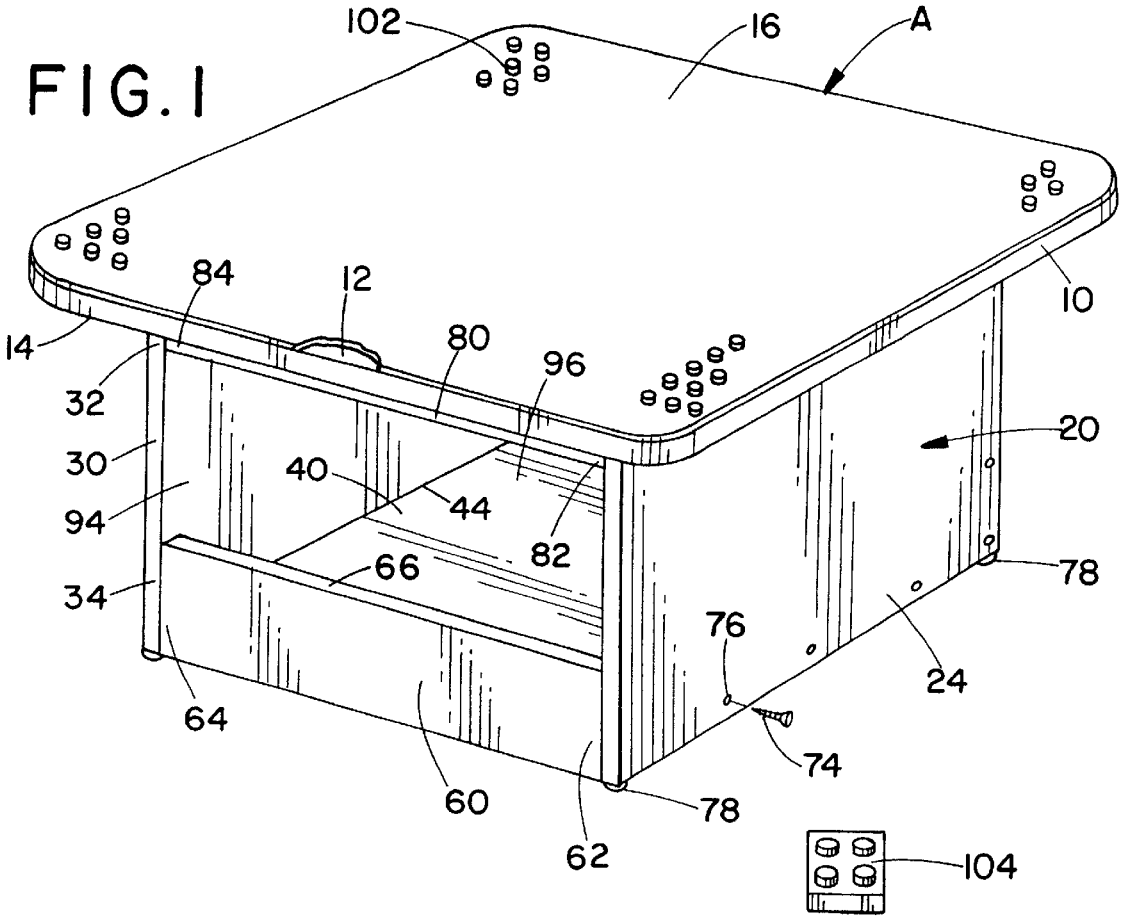
FIG. 2A
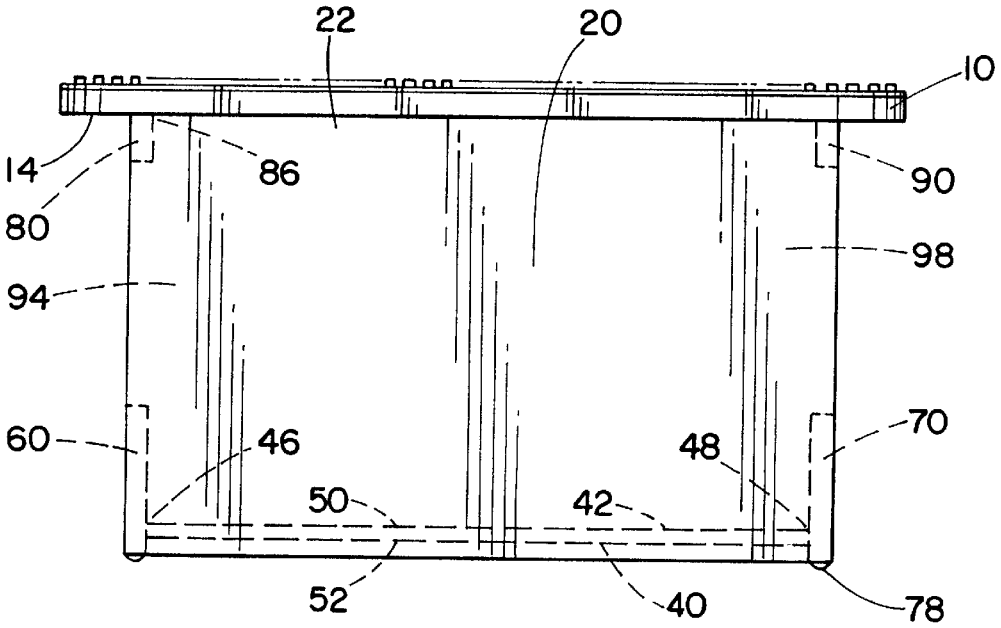
FIG. 2

PLAY TABLE AND MERCHANDISING SYSTEM

This application is a continuation-in-part of U.S. patent application Ser. No. 08/377,700 which was filed on Jan. 25, 1995 and now U.S. Pat. No. 5,615,619 dated Apr. 1, 1997. The disclosure of that application is incorporated hereinto in its entirety by reference.

BACKGROUND OF THE INVENTION

The present invention relates to play tables. More specifically, the invention relates to a play table having a storage feature wherein the play table can be employed either with blocks or with gears and wherein the play table can also be employed as part of a merchandising system.

The play table described herein can be used to provide both a play surface and a storage base for the elements of a modular block building system. Alternatively, the play table can be used, when employed with a suitable top surface, to provide a play surface and storage for the elements of a known interlocking gear play system. The storage table according to the present invention can also be constructed as an "end cap" or merchandising display system employed at the end of store aisles.

There are known play table designs which have a play surface on which a modular building system can be supported. However, the known designs do not have a large capacity storage bin. In addition, none of the known play table designs are capable of accommodating an interlocking gear play system. Finally, none of the known play table designs are so constructed as to be useable in a merchandising environment.

Accordingly, it has been considered desirable to develop a new and improved play table which would overcome the foregoing difficulties and others while providing better and more advantageous overall results.

BRIEF SUMMARY OF THE INVENTION

In accordance with the present invention, a new and improved merchandising and play table is provided.

More particularly in accordance with this aspect of the invention, the play table comprises a top and a first leg secured at its upper end to the top for supporting the top. A second leg is secured at its upper end to the top for supporting the top, the second leg being spaced from the first leg. A bottom wall is secured between the lower ends of the first and second legs. A front wall is secured to the first and second legs. The front wall cooperates with the first and second legs and the bottom wall to define a bin housed under the top. The front wall is of less height than the first and second legs to define a front opening for the bin. A rear wall of the play table is secured to at least one of the top, the first leg and the second leg and extends above the top. The rear wall includes means for cooperating with an associated merchandise display holder.

In accordance with another aspect of the invention, a new and improved play table for use with a modular toy system having a plurality of interlocking elements is provided.

More particularly in accordance with this aspect of the invention, the play table comprises a substantially horizontal planar top including a studded play surface accommodating associated toy elements for interlocking engagement. A base is secured at its upper end to the top and supports the top. The base comprises a pair of spaced side walls, a front wall, a rear wall and a bottom wall. The bottom wall is secured to the pair of side walls, wherein the pair of side walls, the front wall, the rear wall and the bottom wall define a bin located beneath the top. A first opening is associated with at least one of the walls of the base to provide access to the bin for storing the associated toy elements.

In accordance with still another aspect of the present invention, a storage and merchandise display center is provided.

More particularly in accordance with this aspect of the invention, the center comprises a first top and a first base secured at its upper end to the first top for supporting the first top. The first base comprises a pair of side walls, a front wall and a bottom wall, wherein the pair of side walls, the front wall and the bottom wall define a first bin located beneath the first top. A first opening is associated with at least one of the walls of the first base to provide access to the first bin for storing objects therein. A rear wall is secured to at least one of the first top and the first base. The rear wall has a first section extending above the first top. The rear wall comprises a means for cooperating with an associated merchandise display holder.

One advantage of the present invention is the provision of a new and improved play table.

Another advantage of the present invention is the provision of a play table which has a large storage bin beneath it so as to accommodate a sizeable volume of toys.

Still another advantage of the present invention is the provision of a play table which has a wide base that is directly supported on the subjacent floor so as to prevent the table from being easily tipped by a child playing thereon.

Yet another advantage of the present invention is the provision of a play table having at least one access opening to a bin provided underneath the play surface so that toys can be stored in or removed from the bin. Preferably, more than one access opening is provided so that access may be had to the bin from different locations around the table.

A further advantage of the present invention is the provision of a play table with at least one storage bin underneath it wherein an access opening to the storage bin is not closed by a door or the like so that the storage bin is always accessible and does not pose a hazard to children.

A still further advantage of the present invention is the provision of a play table having a top with a studded play surface. The studded play surface can accommodate interlocking gear pieces that allow building horizontally or vertically. Beneath the top is a base comprising a storage bin for storing the gear elements.

A yet further advantage of the present invention is the provision of a play table having a top which is selectively removable so that it can be replaced with another style of top that can be used with a different type of play element.

An additional advantage of the present invention is the provision of a table which is incorporated in a merchandising system. More particularly, the merchandising system can include a back wall of the table. The back wall extends above the level of a top of the table and is suitably configured so as to interlock with a merchandise display means in order to allow a merchant to display goods for sale. This design is useful in end caps that are employed at one or both ends of a store aisle. Alternatively, free standing merchandising centers can be constructed according to the present invention in which a centrally extending vertical wall has a table located on both sides of it to form a two sided merchandise display center. The table can, if desired, be a play table. Alternatively, merchandise can also be displayed on the table top and stored in a bin underneath the top.

Still further advantages of the present invention will become apparent to those of ordinary skill in the art upon a reading and understanding of the following detailed description of the preferred embodiments.

BRIEF DESCRIPTION OF THE DRAWINGS

The invention may take form in certain parts and arrangements of parts preferred embodiments of which will be described in detail in this specification and illustrated in the accompanying drawings which form a part here of and wherein:

FIG. 1 is a perspective view of a play table according to a first preferred embodiment of the present invention;

FIG. 2 is a side elevational view of the play table of FIG. 1;

FIG. 2A is an enlarged perspective view of a block that can be used with a studded play surface located on the play table of FIG. 1;

DETAILED DESCRIPTION OF THE PREFERRED EMBODIMENTS

Figure 3:
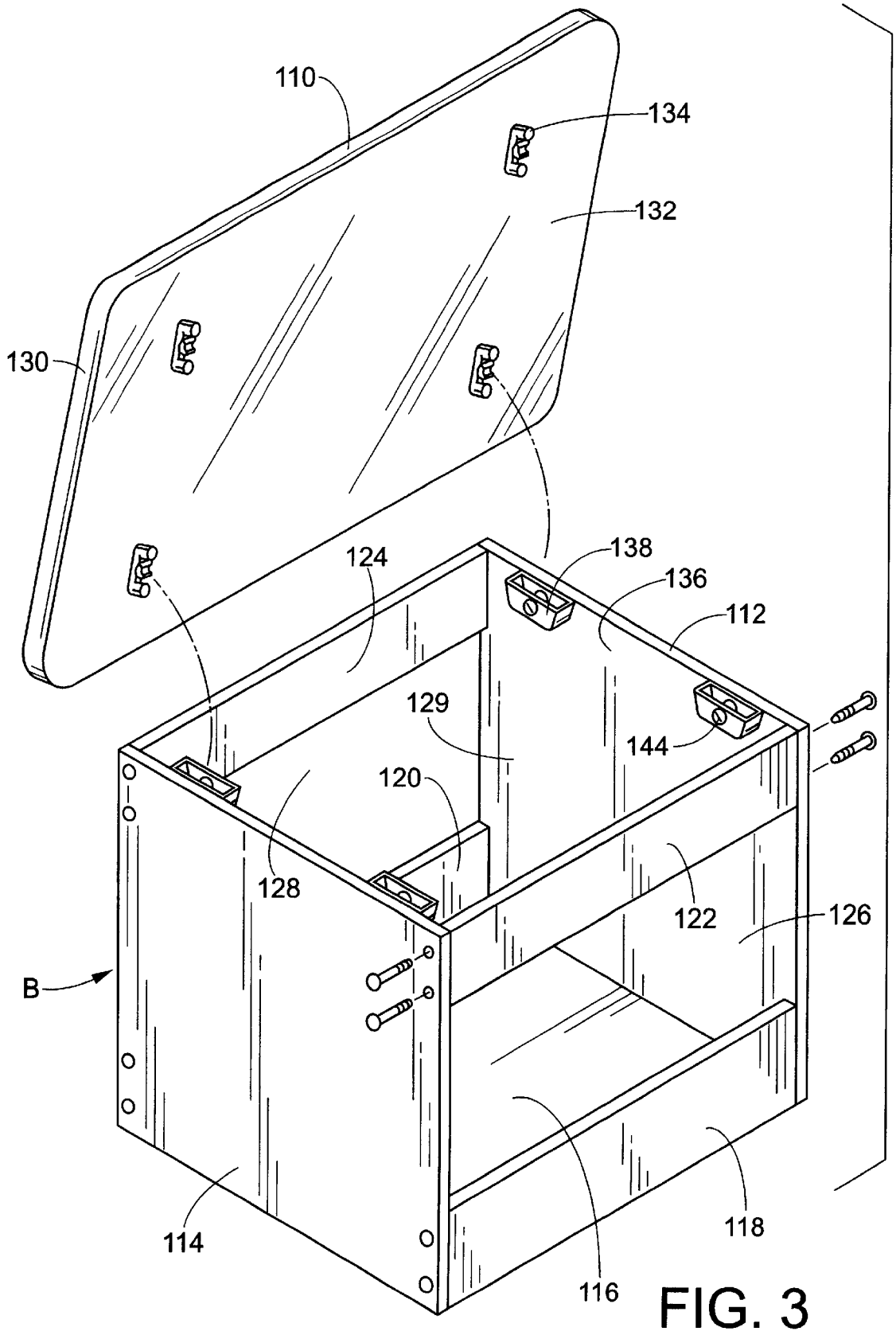
FIG. 3 is a perspective view of a play table according to a second preferred embodiment of the present invention illustrating a selectively removable top surface.

Referring now to the drawings wherein the showings are for purposes of illustrating preferred embodiments of the invention only and not for purposes of limiting same, FIG. 1 shows a play table A according to a first preferred embodiment of the present invention. FIG. 1 illustrates that the play table A comprises a top 10 having an upper surface 12 and a lower surface 14. If desired, a block building plate 16 can be secured, as by a conventional adhesive or by known fasteners, to the upper surface 10 of the play table. It is evident from FIG. 1 that the top 10 has rounded corners so as to reduce the possibility of harm to the children using the play table.

Supporting the play table is a base including a first leg 20 having an upper end 22 which is secured to the lower surface 14 of the play table as by screws, adhesive or the like (not visible). The first leg also has a lower end 24 which sits on a subjacent support surface such as the floor. Also provided is a second leg 30 which is spaced from the first leg 20. The second leg has an upper end 32 which is secured to the lower surface 14 of the top and a lower end 34 which rests on the subjacent support surface. The two legs 20 and 30 are substantially planar and are widely spaced apart so as to provide a stable base for the top. Extending between the lower ends 24 and 34 of the first and second legs is a bottom wall 40. The bottom wall has a first side edge 42 (FIG. 2) secured to the first leg 20 and a second side edge 44 secured to the second leg 30. With reference now to FIG. 2, the bottom wall also includes a front edge 46 and a rear edge 48. In addition, the bottom wall has an upper surface 50 and a lower surface 52.

With reference again to FIG. 1, the play table A preferably further comprises a front wall 60 which extends between the first and second legs 20 and 30 such that a first end 62 is secured to the first leg and a second end 64 secured to the second leg. The front wall 60 also includes a top surface 66 which is accessible to a child playing on the table A.

With reference now to FIG. 2, the play table A further comprises a back wall 70 which, as with the front wall, is secured between the two legs 20 and 30. The means for securing the first and second legs 20 and 30 to the top 10, as well as the bottom wall 40 to the first and second legs, and the front and back walls 60 and 70 to the first and second legs can be suitable fasteners 74 which extend through apertures 76 provided in the relevant wall surfaces. Not all of the fasteners and apertures are illustrated in FIG. 1 for the sake of simplicity. In addition, it should be appreciated that other conventional means for securing the several walls of the play table together can also be provided, such as adhesives, brackets or the like.

The first and second legs 20 and 30, the bottom wall 40 and the front and rear walls 60 and 70 together comprise a base. To prevent scratching, marring and the like of the subjacent floor surface, preferably the four corners of the base are provided with tips 78 of a conventional kind. The tips are also advantageous from the standpoint of allowing the base to compensate for any floor unevenness. It can be seen from FIG. 2 that the bottom wall 40 is located slightly above the bottom edges of the first and second legs and the front and back walls in order to stiffen the construction of the base.

Preferably, the play table further comprises a front brace 80. As shown in FIG. 1, the front brace includes a first end 82 that is secured to the first leg 20, a second end 84 which is secured to the second leg 30. A top wall 86 (FIG. 2) supports a lower surface 14 of the top 10 and is preferably secured thereto. A rear brace 90 (FIG. 2) can also be provided adjacent the rear end of the table. As with the front brace, the rear brace is similarly secured to the first and second legs 20 and 30 and to the top 10. Defined between the front wall 60 and the front brace 80 is a front access opening 94 of a bin 96 located in the base. In addition, a rear access opening 98 is defined between the back wall 70 and the rear brace 90, as illustrated in FIG. 2.

As shown in FIG. 1, the block building plate 16 comprises a plurality of spaced studs 102. These studs cooperate with a known building block 104 which is illustrated in FIG. 2A. Such building blocks are sold by several corporations. The most well known is the Lego Corporation of Denmark which sells its building blocks under the trademarks LEGO® and DUPLO®. The storage bin 96 is of large volume and is capable of holding several hundred preschool size playing blocks.

The components of the play table A, namely the top 10 and the base including the first and second legs 20 and 30, bottom wall 40, front and back walls 60 and 70 and front and rear braces 80 and 90, are preferably made from a suitable conventional material such as wood. The walls of the table are sufficiently thick so as to make for a strong and very safe play table which is adaptable for either commercial or home use. It should be appreciated, however, that the play table could also be manufactured from a plastic material.

As is evident from FIG. 2, the top 10 overhangs the base by, for example, 4 inches or so. Such overhang is useful to accommodate the legs of children who may be seated adjacent the play table and playing on the block building plate 16 thereof.

It should be appreciated that no doors are provided to close the access openings 94 and 98 of the play table. The absence of such doors is advantageous from the standpoint that children playing on the table will not get their fingers pinched in a door, nor become trapped inside the bin 96 if any such doors were to be closed.

With reference now to FIG. 3, the second preferred embodiment of the play table B according to the present invention is there illustrated. This embodiment employs a top 110, a first leg 112, a second leg 114 and a bottom wall 116. Also provided is a front wall 118 and a rear wall 120. Further provided are a front brace 122 and a rear brace 124. The front wall and front brace and the rear wall and rear brace together define a front opening 126 and a rear opening 128 of a bin 129.

Figure 4A:
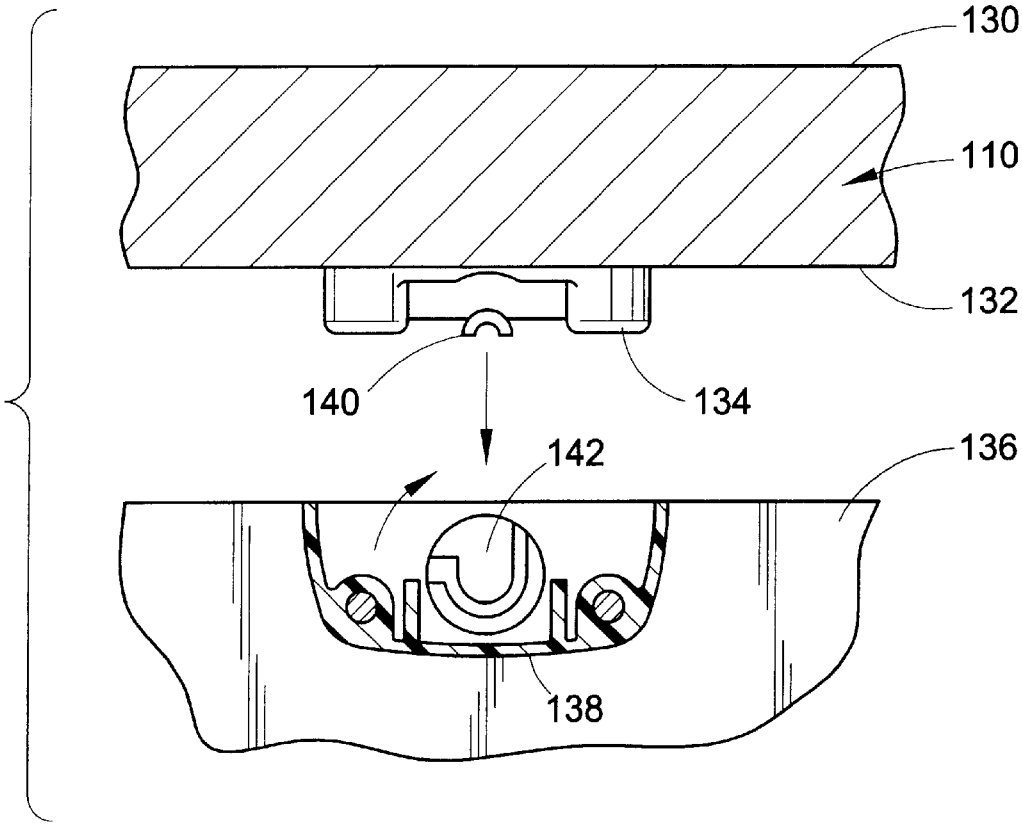
FIG. 4A is an enlarged exploded sectional view illustrating a locking mechanism for selectively securing the top surface and the base of FIG. 3.
Figure 4B:
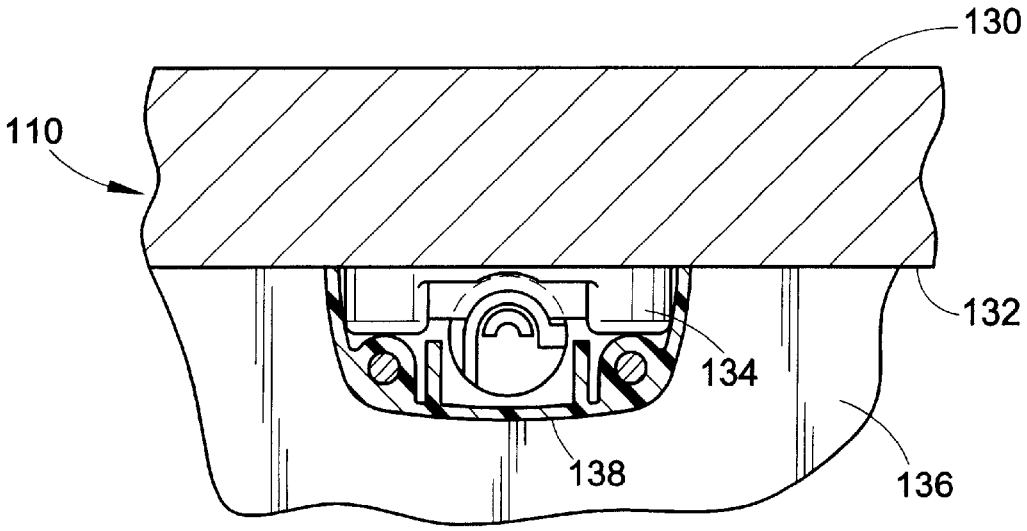
FIG. 4B is an assembled sectional view of the top surface and base of FIG. 4A in a locked condition.

The top 110 includes an upper surface 130 and a lower surface 132. Secured on the lower surface 132 is a first fastener element 134. Located on an inner surface 136 of the first leg 112 is a second fastener element 138 which cooperates with the first fastener element. With reference now also to FIG. 4A, the first fastener element 134 includes a prong 140 that can be selectively held by a rotatable lock 142 positioned in the second fastener element 138 as illustrated by a comparison of FIGS. 4A and 4B. A screw 144 (FIG. 3) can be rotated in order to move the rotatable lock 142. It should also be appreciated from FIG. 3 that identical fastening means are provided on the top lower surface 132 for cooperation with the second leg 114. In this way, a top 110 can be replaced with another top should that become necessary. This type of fastener system is sold as part No. C066F1 by Liberty Industries of High Point, N.C. Of course, it should be appreciated that other similar fasteners sold by other manufacturers could also be used.

Figure 5:
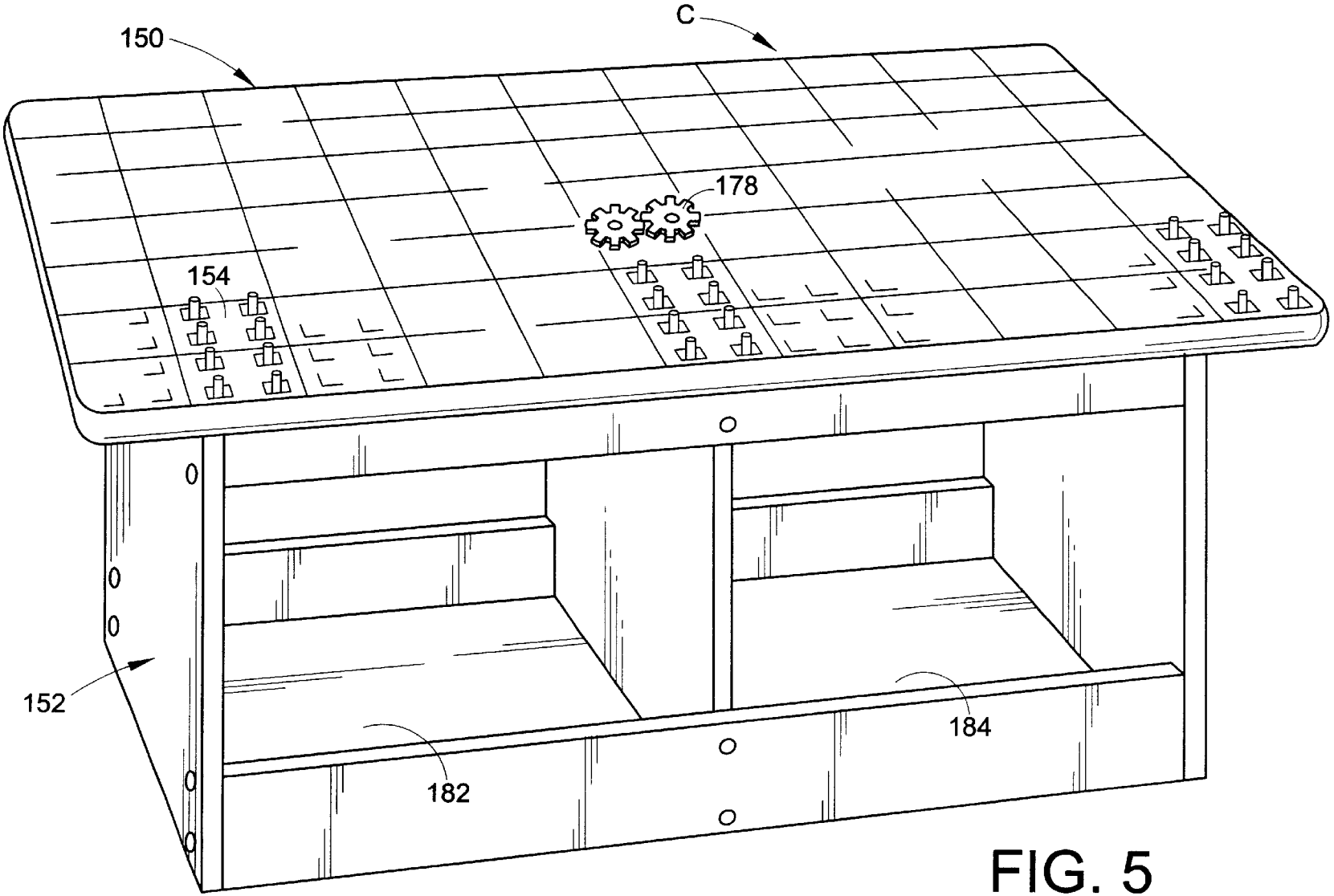
FIG. 5 is a perspective view of a play table according to a third preferred embodiment of the present invention as employed with a modular gear system.
Figure 6A:
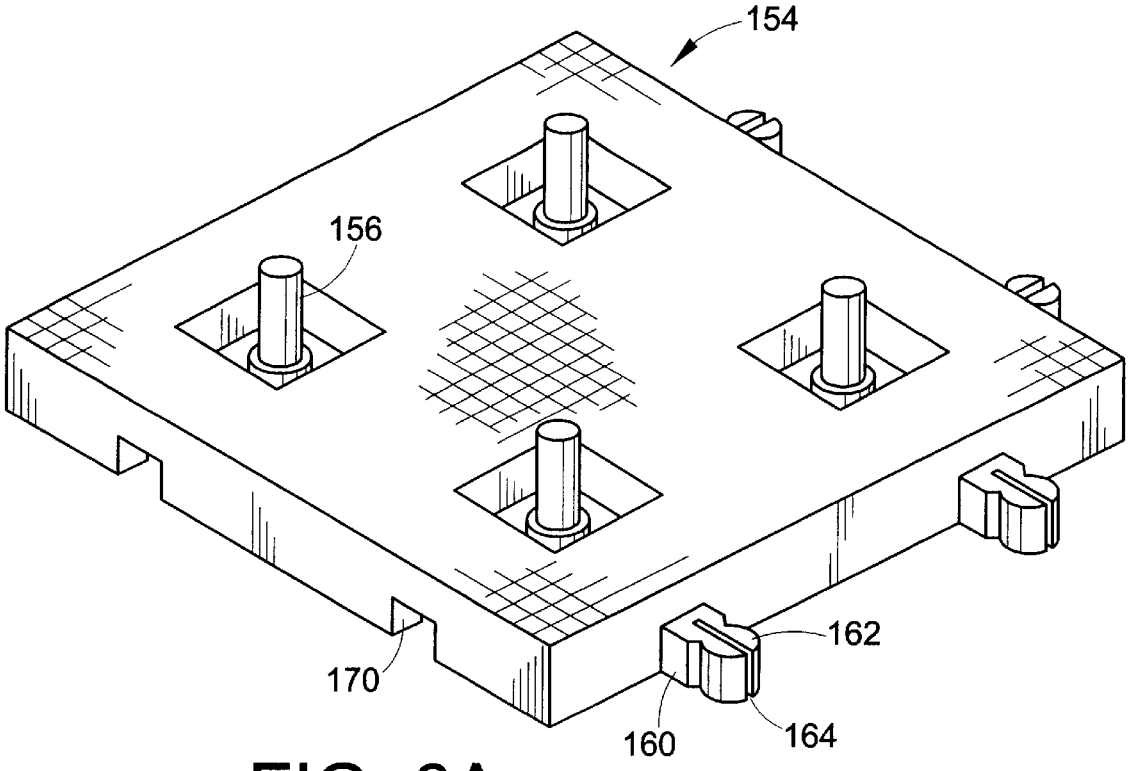
FIG. 6A is an enlarged perspective view of a studded base element used with the modular gear play system FIG. 5.
Figure 6B:
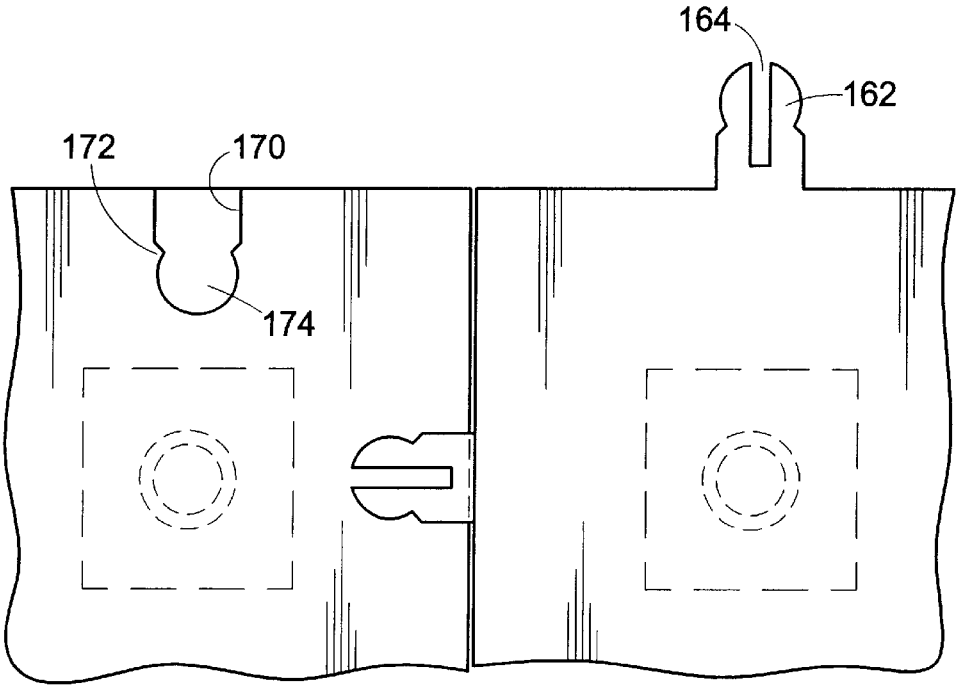
FIG. 6B is a bottom plan view of an interlocking engagement between a pair of base elements of the studded play surface of FIG. 5.

With reference now to FIG. 5, a third preferred embodiment of a play table C according to the present invention is there illustrated. This embodiment employs a top 150 for a play table also having a base 152. The top includes a series of building plates 154. With reference now to FIG. 6A, each building plate 154 includes at least one upwardly extending stem or stud 156. The building plate 154 can, if desired, comprise a square element having on two of its faces protruding teeth 160. Each tooth includes a pair of rounded distal ends 162 separated by a slot 164. It is noted that the teeth 160 are only approximately half the height of the building plate 154. Each plate also includes on its other two edges a pair of sockets 170 which are meant to cooperate with the teeth 160 as is best illustrated in FIG. 6B. To this end, the slots have a reduced width central portion 172 and an enlarged distal area 174 for receiving the distal ends 162 of the teeth. The teeth 160 can selectively be inserted in the sockets 170. The teeth snap fit in place but can be removed due to the resilience of the conventional thermoplastic material from which the plates 154 are made and due to the resilient nature of the teeth distal ends 162 because of the presence of the slot 164 between them. It should also be noted that due to the half height nature of the teeth 160 and sockets 170, a top view of the building plates 154 does not show the interengagement of the several plates. This can be seen from a comparison of FIG. 5 with FIG. 6B.

With reference again to FIG. 5, the studs 156 are meant to cooperate with suitable gears 178 which have interengaging teeth. Such gears are conventional and are sold by Learning Resources of Lincolnshire, Ill. The gears have interlocking pieces which allow building horizontally and vertically. When a child is done playing with the gears, all of the construction elements of the gears system can be stored in a pair of bins 182 and 184 defined in the base 152.

Figure 7:
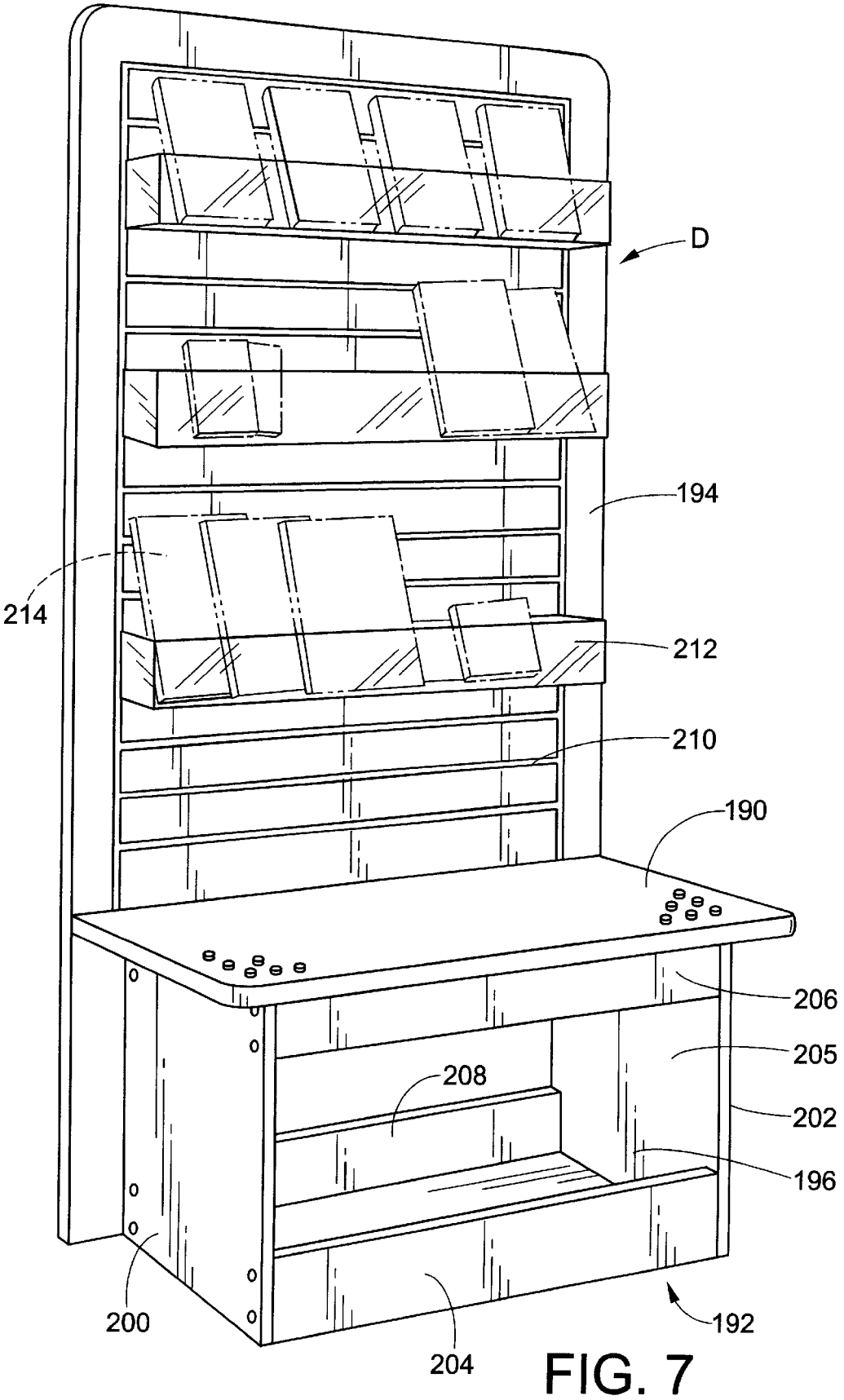
FIG. 7 is a perspective view of a play table and merchandising system according to a fourth preferred embodiment of the present invention.

With reference now to FIG. 7, an end cap D employing a play table according to a fourth preferred embodiment of the present invention is there disclosed. The end cap comprises a top 190, a base 192 and a vertically disposed display wall 194. The base 192 forms a bin 196 disposed below the top 190.

As in the previous embodiments, the base 192 comprises first and second legs 200 and 202, as well as a front wall 204. A front opening 205 is associated with the front wall 204 to provide access to the bin 196. If desired, a front brace 206 can also be provided. Moreover, if desired, a rear wall 208 can be provided in addition to the display wall 194. However, it should be appreciated that the display wall 194, since it extends the entire height of the display table, can substitute as the rear wall of the play table.

The display wall 194 can be secured to either the top 190 or the base 192, or both, by any suitable conventional means such as, e.g., adhesive or fasteners, such as the fasteners disclosed in FIG. 1, or the fastening system disclosed in FIG. 3. The display wall 194 includes a plurality of spaced horizontally extending grooves 210. The grooves are adapted to cooperate with suitable merchandise display elements, such as shelves 212 on which a variety of merchandise 214 can be displayed. However, it should be appreciated that a large variety of other known types of merchandise display elements can be selectively secured to a suitably configured display wall. For example, one could employ sign holders, a variety of shelf systems, product merchandising strips, shelf brackets, peg hooks, display hooks of various sorts, or a variety of literature holders or the like.

The top 190 of this embodiment allows children to play with suitable blocks or gears. These items can, after play, be stored in the bin 196 formed in the base. At the same time, while the children are occupied, the merchant can display to both the children and the adults with them, a variety of merchandise 214, such as books, videotapes or toys for sale.

Figure 8:
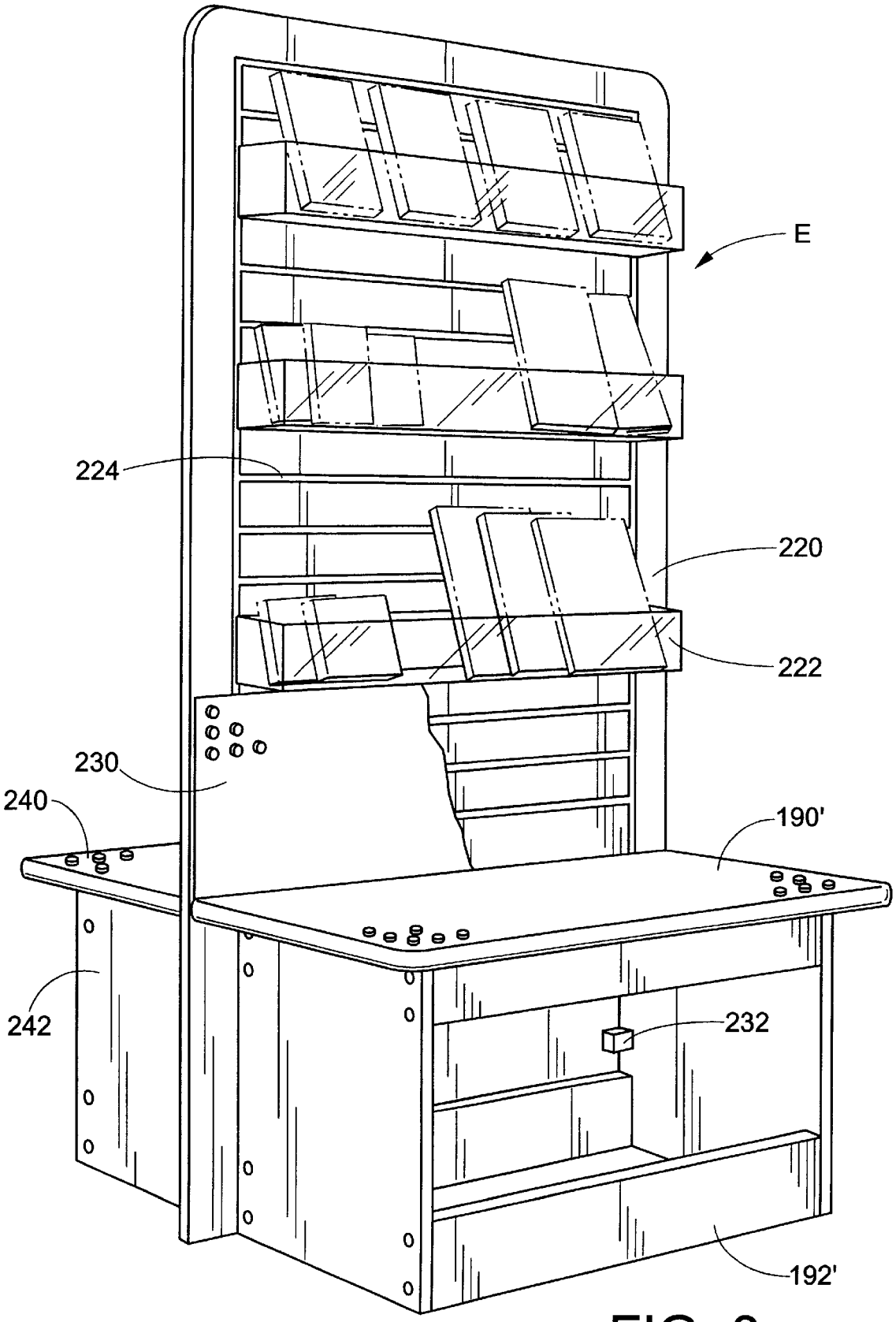
FIG. 8 is a perspective view of a two sided play table and merchandising system according to a fifth preferred embodiment of the present invention; and, FIG. 9 is a top plan view of a play table according to another preferred embodiment of the present invention.

With reference now to FIG. 8, a two sided end cap E according to a fifth preferred embodiment of the present invention is there illustrated. For ease of understanding and appreciation of this embodiment of the invention, like components are identified by like numerals with a primed (') suffix and new components are identified by new numerals.

In this embodiment, a first play table, including a top 190' and a base 192' is provided on one side of a double sided display wall 220. The display wall accommodates a series of merchandise display elements, such as shelves 222 which have rear surfaces cooperating with suitable grooves 224 cut into the display wall. It should be evident that the opposite side of the display wall (not visible in FIG. 8) is similarly arranged.

If desired, a plate 230 can be secured by conventional means, such as fasteners or adhesive, to a lower portion of the display wall 220 as is illustrated in FIG. 8. With such a plate 230, a child can play not only on the top 190', but also on the vertically disposed plate 230. This construction allows children to use their imagination more fully in constructive play while waiting for their parents to shop. A suitable fastener system 232 can be employed to secure the display wall 220 to at least one of the top 190' and the base 192'. The fastener system 232 can be the same as the fastening system illustrated in FIGS. 4A and 4B if so desired.

Secured to the opposite side of the display wall is a second top 240 and a second base 242. With a two sided hands on play center as is illustrated in FIG. 8, children are enticed to take play elements out of the bins provided in the pair of bases 192' and 242. At the same time, both children and adults have displayed to them the variety of merchandise held on the two sided display wall 220. It should be appreciated that the second top 240 can have a different surface than the first top 190'. For example, the first top 190' can have a studded play surface such as is illustrated in FIGS. 1–2A while the second top 240 can have a gear type play surface such as is illustrated in FIG. 5. Alternatively, the second top can have a plain surface.

Further, the second top could have a bead and wire frame toy located thereon. One such toy is disclosed by U.S. Pat. No. 5,112,268 dated May 12, 1992. Of course, a suitably configured bead and wire frame toy could also be located on the display wall 220 in place of the second top 240, if desired.

It should be appreciated that with all of the embodiments illustrated herein, a suitable conventional seating surface would be useful in order to allow the child to play on the play surfaces disclosed. With different heights of play surfaces, different sized chairs or benches may be needed.

While the embodiments of FIGS. 7 and 8 have been discussed as incorporating a child's play surface on the respective tops 190, 190' and 240, it should be appreciated that the end caps D and E could simply be used for display and storage. In other words, the tops 190, 190' and 240 could, instead, have a plain surface and could be employed simply to display merchandise. The respective bins, such as bin 196, could then be used simply to store merchandise out of the way until it is needed for display purposes on the respective rear walls of the end caps.

Figure 9:
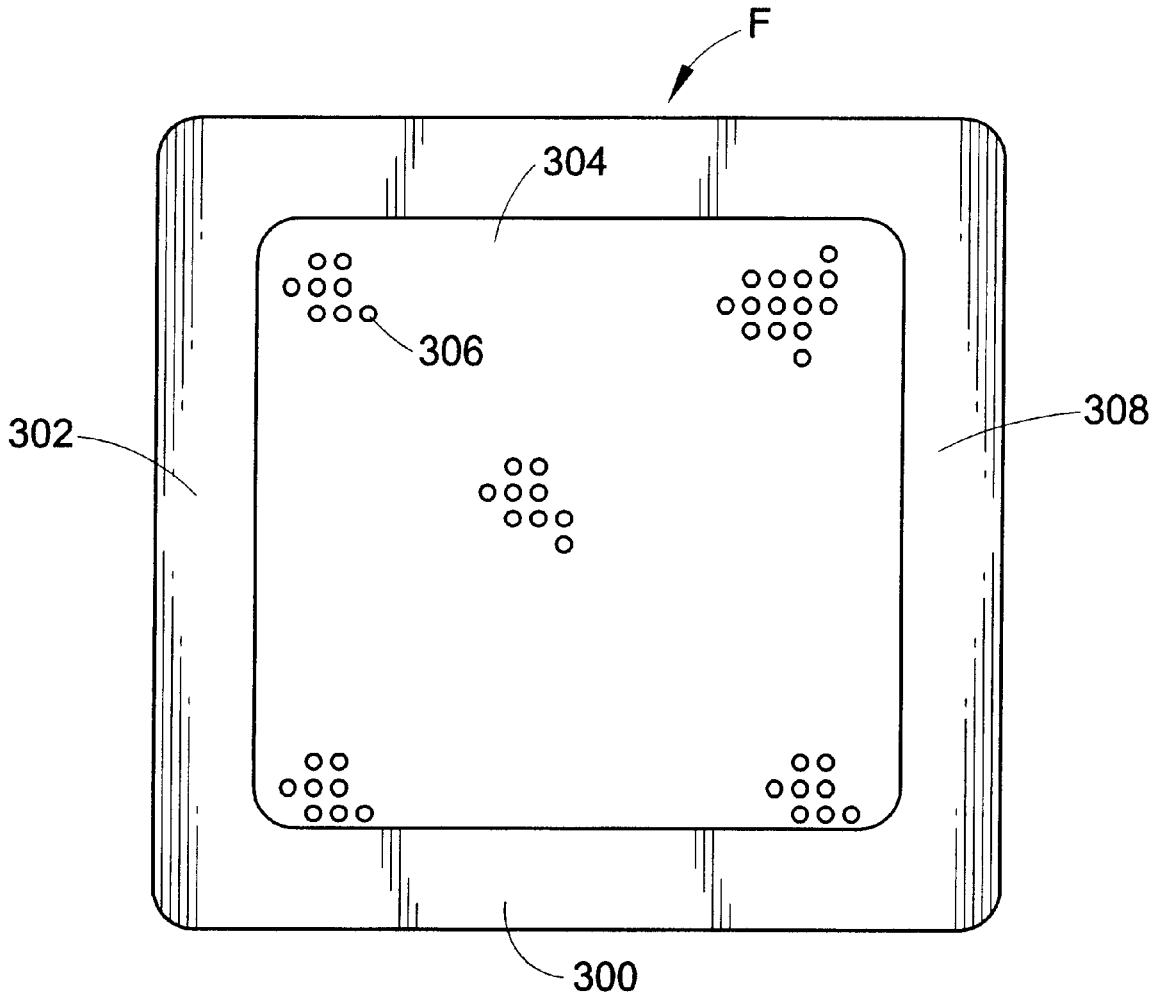

With reference now to FIG. 9, there is provided a play table F according to another preferred embodiment of the present invention. This play table includes a top 300 having an upper surface 302 to which is secured a block building plate 304 having a plurality of spaced studs 306. However, in the embodiment of FIG. 9, the block building plate 304 is smaller in circumference than is the top 300. Therefore, a smooth surface area 308 is defined on the upper surface 302 of the top around the periphery of the plate 304.

The invention has been described with reference to several preferred embodiments. Obviously, modifications and alterations will occur to others upon a reading and understanding of the preceding detailed specification. It is intended that the invention be construed as including all such modifications and alterations insofar as they come within the scope of the appended claims or the equivalents thereof.

What is claimed is:

1. A play table and merchandise display center comprising:

a top;

a first leg secured at its upper end to said top for supporting said top;

a second leg secured at its upper end to said top for supporting said top, said second leg being spaced from said first leg;

a bottom wall secured between said first and second legs;

a front wall secured to said first and second legs, wherein said front wall cooperates with said first and second legs and said bottom wall to define a bin housed under said top and wherein said front wall is of less height than said first and second legs to define a front opening for said bin; and, a rear wall secured to at least one of said top, said first leg and said second leg, said rear wall extending above said top and comprising a fastener extending from an inside surface of one of said first and second legs and said top to said rear wall to secure said rear wall in place and a means for cooperating with an associated merchandise display holder, wherein said top overhangs said first and second legs of said bin.

2. The table and center of claim 1 wherein said top comprises a studded play surface, said studded play surface accommodating associated blocks for interlocking engagement.

3. The table and center of claim 2 further comprising a studded plate secured to said rear wall at a location adjacent said studded play surface comprising said top.

4. The table and center of claim 1 wherein said top comprises a studded play surface, said studded play surface accommodating associated gears for rotational engagement with each other wherein each stud serves as a hub for a respective gear.

5. The table and center of claim 1 wherein said rear wall extends downwardly towards said bottom wall.

6. The table and center of claim 5 wherein said rear wall is secured to said first and second legs.

7. A play table and merchandise display center comprising:

a top;

a first leg secured at its upper end to said top for supporting said top;

a second leg secured at its upper end to said top for supporting said top, said second leg being spaced from said first leg;

a bottom wall secured between said first and second legs;

a front wall secured to said first and second legs, wherein said front wall cooperates with said first and second legs and said bottom wall to define a bin housed under said top and wherein said front wall is of less height than said first and second legs to define a front opening for said bin; and, a rear wall secured to at least one of said top, said first leg and said second leg, said rear wall extending above said top and comprising a means for cooperating with an associated merchandise display holder; and, a front brace secured to said first and second legs and said top, said brace being spaced from said front wall such that said front opening is defined between them.

8. A play table for use with a modular toy system having a plurality of interlocking elements, comprising:

a substantially horizontal planar top including a studded play surface accommodating associated toy elements for interlocking engagement;

a base secured at its upper end to said top and supporting said top, said base comprising a pair of spaced side walls, a front wall, a rear wall and a bottom wall, said bottom wall being secured to said pair of side walls, wherein said pair of side walls, front wall, rear wall and bottom wall define a bin located beneath said top;

a first opening located between one of said walls of said base and said top to provide access to said bin for storing the associated toy elements; and, wherein said top overhangs said pair of spaced side walls of said base such that a circumference of said top is larger than a circumference of said base.

9. The play table of claim 8 further comprising a substantially vertically extending wall in said base for separating said bin into two adjacent storage areas.

10. The play table of claim 8 wherein the associated toy elements comprise gears and wherein said studded play surface comprises a plurality of spaced stud elements, each of which acts as a hub for a respective one of the associated gears.

11. The play table of claim 10 wherein said studded play surface comprises a plurality of building plates which are secured to each other.

12. The play table of claim 8 further comprising a connecting means for selectively securing said top to said base.

13. The play table of claim 8 wherein an area of said studded play surface is smaller than an area of said top in order to define a smooth surface portion on said top.

14. The play table of claim 8 wherein said top overhangs said front wall of said base.

15. The play table of claim 14 wherein said top overhangs said rear wall of said base.

16. The play table of claim 8 wherein said studded play surface comprises a block building plate which is secured to said top.

17. The play table of claim 8 further comprising a second opening located between another one of said walls of said base and said top to provide access to said bin.

18. The play table of claim 17 wherein said first opening and said second opening are located on opposed walls of said base.

19. A storage and merchandise display center comprising:

a first top;

a first base secured at its upper end to said first top and supporting said first top, said first base comprising:

a pair of side walls, a front wall, and a bottom wall wherein said pair of side walls, front wall and bottom wall define a first bin located beneath said first top;

a first opening located between at least one of said walls of said first base and said first top to provide access to said first bin for storing objects therein; and, a rear wall secured to at least one of said first top and said first base, said rear wall including a first section extending above said first top, said rear wall comprising a means for cooperating with an associated merchandise display holder wherein said toy overhangs said pair of side walls of said base such that a circumference of said top is larger than a circumference of said base.

20. The center of claim 19, further comprising:

a second top and a second base secured at its upper end to said second top and supporting said second top, said second base comprising:

a pair of side walls, a front wall; and, a bottom wall, said pair of side walls, front wall and bottom walls cooperating to define a second bin located beneath said second top, wherein said rear wall is also secured to said second top and said first section of said rear wall extends above said second top.

21. The center of claim 20 wherein said second top and said second base are located on a side of said rear wall opposite to a side on which said first top and said first base are located.

22. The center of claim 19 wherein said rear wall means for cooperating comprises at least one groove.

23. The center of claim 19 further comprising a pair of fasteners for securing said rear wall to said base, a respective fastener securing said rear wall to a respective one of said pair of side walls of said base.

24. The center of claim 19 wherein said rear wall further comprises a second section which extends downwardly toward said bottom wall of said first base, said second section being secured to said pair of side walls of said first base.

* * * * *